US007905562B2

(12) United States Patent
Kanai

(10) Patent No.: US 7,905,562 B2
(45) Date of Patent: Mar. 15, 2011

(54) LIQUID GUIDING DEVICE AND LIQUID EJECTING APPARATUS

(75) Inventor: Fumiyuki Kanai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 840 days.

(21) Appl. No.: 11/853,695

(22) Filed: Sep. 11, 2007

(65) Prior Publication Data

US 2008/0106570 A1 May 8, 2008

(30) Foreign Application Priority Data

Sep. 11, 2006 (JP) ..... 2006-246022
Sep. 7, 2007 (JP) ..... 2007-232388

(51) Int. Cl.
*B41J 3/00* (2006.01)
*B41J 29/38* (2006.01)
*B41J 2/155* (2006.01)

(52) U.S. Cl. ..... 347/4; 347/13; 347/42

(58) Field of Classification Search ..... 347/4
See application file for complete search history.

(56) References Cited

FOREIGN PATENT DOCUMENTS

| | | |
|---|---|---|
| JP | 07-285251 | 10/1995 |
| JP | 10-166562 | 6/1998 |
| JP | 2002-086821 | 3/2002 |
| JP | 2004-249627 | 9/2004 |
| JP | 2005-125800 | 5/2005 |
| JP | 2005-280332 | 10/2005 |
| JP | 2006-205697 | 8/2006 |
| JP | 2006205697 * | 8/2006 |

* cited by examiner

*Primary Examiner* — Uyen-Chau N Le
*Assistant Examiner* — Kajli Prince
(74) *Attorney, Agent, or Firm* — Workman Nydegger

(57) ABSTRACT

To provide a liquid guiding device such that, when liquid is dumped onto a sloping guiding surface portion located in a region where ink is dumped, the liquid is easily guided to an ink absorber and no liquid remains on the guiding surface portion. A guiding surface portion 29 is provided in a liquid dumping region 23 in which ink absorbers 25 and 26 are provided and on the upstream edge of a downstream portion 24 of a platen. The upper surface of the guiding surface portions 29 slopes down toward the upstream side, that is, toward the liquid dumping region 23. In the guiding surface portion 29 is formed a guiding structure portion 31 that guides ink attached to the guiding surface portion to the ink absorber 25. The guiding structure portion may include an edge portion 31 that guides liquid by capillary action. The edge portion may extend to the ink absorbers 25 and 26.

6 Claims, 11 Drawing Sheets

LIQUID GUIDING DEVICE AND LIQUID EJECTING APPARATUS

BACKGROUND

1. Technical Field

The present invention relates to a liquid guiding device in a liquid ejecting apparatus, such as an ink jet recording apparatus, that discharges liquid from its head to spray a medium.

Liquid ejecting apparatuses are not limited to recording apparatuses, such as printers, copying machines, and facsimiles, in which an ink jet recording head is used and that discharge ink from the recording head to perform recording on a recording medium. Liquid ejecting apparatuses include apparatuses that eject, instead of ink, liquid corresponding to their uses from a liquid ejecting head corresponding to the recording head onto a medium to be sprayed corresponding to the recording medium so as to attach the liquid to the medium.

Other than the recording head, liquid ejecting heads include a color material ejecting head used for manufacturing color filters of, for example, liquid crystal displays, an electrode material (conductive paste) ejecting head used for forming electrodes of, for example, organic EL displays and field emission displays (FEDs), a bioorganic matter ejecting head used for manufacturing biochips, and a sample ejecting head used as a precision pipette.

2. Related Art

In ink jet recording apparatuses, ink is discharged from a recording head. In order to remove ink dumped outside the edges of a recording medium on a platen, a depressed portion is formed in a region of the platen facing the recording head, an ink absorber is provided therein, and ink is absorbed in the ink absorber. As shown in FIG. 10, in a known platen 101, the upstream side of a downstream portion 101*a* of the platen located on the downstream side of an ink dumping region 103 in the traveling direction of a recording medium is straight and has a rectangular cross section (see the portion shown by reference numeral 105) and an ink absorber 107 is provided up to this portion.

Therefore, even if ink is dumped at a position adjacent to the upstream side of the downstream portion 101*a* of the platen, ink is not attached on the downstream portion 101*a* of the platen, and ink is dumped onto the ink absorber 107. A platen having such a configuration is disclosed in, for example, Patent Document 1.

However, when the entire surface of a recording medium is sprayed with ink, the front end of the recording medium bends downward due to a large amount of attached ink, and the front end of the recording medium can collide with the upstream end of the downstream platen 101*a* (the portion shown by reference numeral 105). In such a case, as shown in FIG. 9, it is possible to extend part of the upstream side of the downstream platen 101*a* into the liquid dumping region 103, to form a guiding surface portion 109 that slopes down toward the liquid dumping region 103, and to upward guide the front end of a recording medium that is bent downward as described above.

However, in such a configuration, since the sloping guiding surface portion 109 is located in the ink dumping region 23, ink 111 remains dumped on the guiding surface portion 109 and can contaminate the underside of the recording medium.

In Patent Document 2, as shown in FIG. 11, there is disclosed a configuration in which a sloping surface 113 is formed on the upstream side of a most upstream platen 101*b*, and arc-shaped grooves 115 successively arranged in the vertical direction and ridges 117 between the grooves 115 are formed in this sloping surface 113. Due to such a configuration, even if ink is sprayed onto the sloping surface 113, ink accumulates in the grooves 115, and the underside of a recording medium is guided by the ridges 117, goes over the ink, and is therefore not contaminated by contact with the ink. However, the amount of ink that accumulates in the arc-shaped grooves 115 is limited. When this amount is exceeded, ink overflows the grooves 115 and can contaminate the vicinity of the platen.

JP-A-2002-86821

JP-A-7-285251

SUMMARY

It is an object of the invention to provide a liquid guiding device in a liquid ejecting apparatus such that, when liquid is dumped onto a sloping guiding surface portion located in a region where liquid such as ink is dumped, the liquid is easily guided to an ink absorber and no liquid remains on the guiding surface portion. In addition, it is another object of the invention to provide a liquid ejecting apparatus having such a liquid guiding device.

To attain the above objects, a liquid guiding device in a liquid ejecting apparatus according to a first aspect of the invention includes: a platen located so as to face a liquid ejecting head; a liquid dumping region provided in a portion of the platen that faces the liquid ejecting head and that extends beyond a liquid discharge region of the liquid ejecting head, the liquid dumping region having a liquid absorber; a guiding surface portion provided on an edge of the platen defining the downstream end of the liquid dumping region, the upper surface of the guiding surface portion sloping down toward the upstream side, the guiding surface portion being protruded into the liquid discharge region; and a guiding structure portion provided in the guiding surface portion and guiding liquid attached to the guiding surface portion to the liquid absorber.

According to the first aspect of the invention, when part of liquid on the guiding surface portion reaches the guiding structure portion, the liquid is easily guided to the liquid absorber through the guiding structure portion, and the liquid on the guiding surface portion is quickly absorbed by the liquid absorber. Therefore, even in the case of a platen that has a guiding surface portion extending into the liquid discharge region of the liquid ejecting head, liquid on the upper surface of the guiding surface portion is removed through the guiding structure portion. Therefore, when a medium to be sprayed goes over the platen, liquid can be prevented from being attached to the underside of the medium to be sprayed.

A liquid guiding device in a liquid ejecting apparatus according to a second aspect of the invention is as follows. In the first aspect, the guiding structure portion includes an edge portion guiding liquid by capillary action, and the edge portion extends to the liquid absorber.

According to this aspect, when part of liquid on the guiding surface portion reaches the edge portion or its vicinity, the liquid is quickly guided to the liquid absorber by capillary action in the edge portion. Once a flow from the edge portion to the liquid absorber is formed, as long as liquid is continuous, all liquid is guided to the liquid absorber through this channel of flow. Therefore, the liquid on the guiding surface portion decreases rapidly.

A liquid guiding device in a liquid ejecting apparatus according to a third aspect of the invention is as follows. In the second aspect, the edge portion is located at the vertex of a V-shaped opening that opens toward the upstream end of the sloping surface of the guiding surface portion.

According to this aspect, when part of liquid on the guiding surface portion reaches the vertex of the V-shaped opening, the liquid is quickly guided to the liquid absorber by capillary action in the edge portion. Once a flow from the edge portion to the liquid absorber is formed, liquid can be quickly guided to the liquid absorber because the width of the flow can be increased in the V-shaped opening.

A liquid guiding device in a liquid ejecting apparatus according to a fourth aspect of the invention is as follows. In the third aspect, the V-shaped opening extends over substantially the entire length of the sloping surface in the direction between the upstream and downstream sides.

According to this aspect, the liquid on the sloping surface can be more effectively removed because the region where liquid begins to be guided is extended.

A liquid guiding device in a liquid ejecting apparatus according to a fifth aspect of the invention is as follows. In the second aspect, the edge portion is located at the lower end of an elongated groove having a V-shaped cross section and extending from the downstream side to the end on the upstream side of the sloping surface of the guiding surface portion.

According to this aspect, when part of liquid on the guiding surface portion reaches the elongated groove, the liquid flows into the edge portion. Once such a channel for liquid flow is formed, liquid is quickly guided from the upstream end of the elongated groove to the ink absorber by capillary action in the edge portion.

A liquid guiding device in a liquid ejecting apparatus according to a sixth aspect of the invention is as follows. In any one of the second to fifth aspects, the radius of curvature of the corner of the edge portion is 0.05 mm or less.

According to this aspect, since the radius of curvature of the edge portion is about 0.05 mm, the capillary action in the edge portion acts effectively, and the efficiency of guiding liquid to the liquid absorber is increased.

A liquid guiding device in a liquid ejecting apparatus according to a seventh aspect of the invention is as follows. In any one of the third to fifth aspects, the vertex angle of the shape of a V is 20° to 60°.

According to this aspect, the capillary action in the edge portion acts effectively, and the efficiency of guiding liquid to the liquid absorber is increased.

A liquid ejecting apparatus according to an eighth aspect of the invention includes: a liquid ejecting head; a platen located so as to face the liquid ejecting head; and a liquid dumping region provided in a portion of the platen that faces the liquid ejecting head and that extends beyond a liquid discharge region of the liquid ejecting head, the liquid dumping region having a liquid absorber. The liquid ejecting apparatus further includes: a sloping guiding surface portion provided in at least part of the upper surface of the edge of the platen that abuts the liquid dumping region of the platen or the upper surface of the edge of a rib that abuts the liquid dumping region of the platen; and a guiding structure portion provided in the guiding surface portion and guiding liquid attached to the guiding surface portion to the liquid absorber. According to this aspect, a high-quality sprayed matter can be obtained because the underside of a medium to be sprayed can be prevented from being contaminated.

DESCRIPTION OF EXEMPLARY EMBODIMENTS

Figure 1:
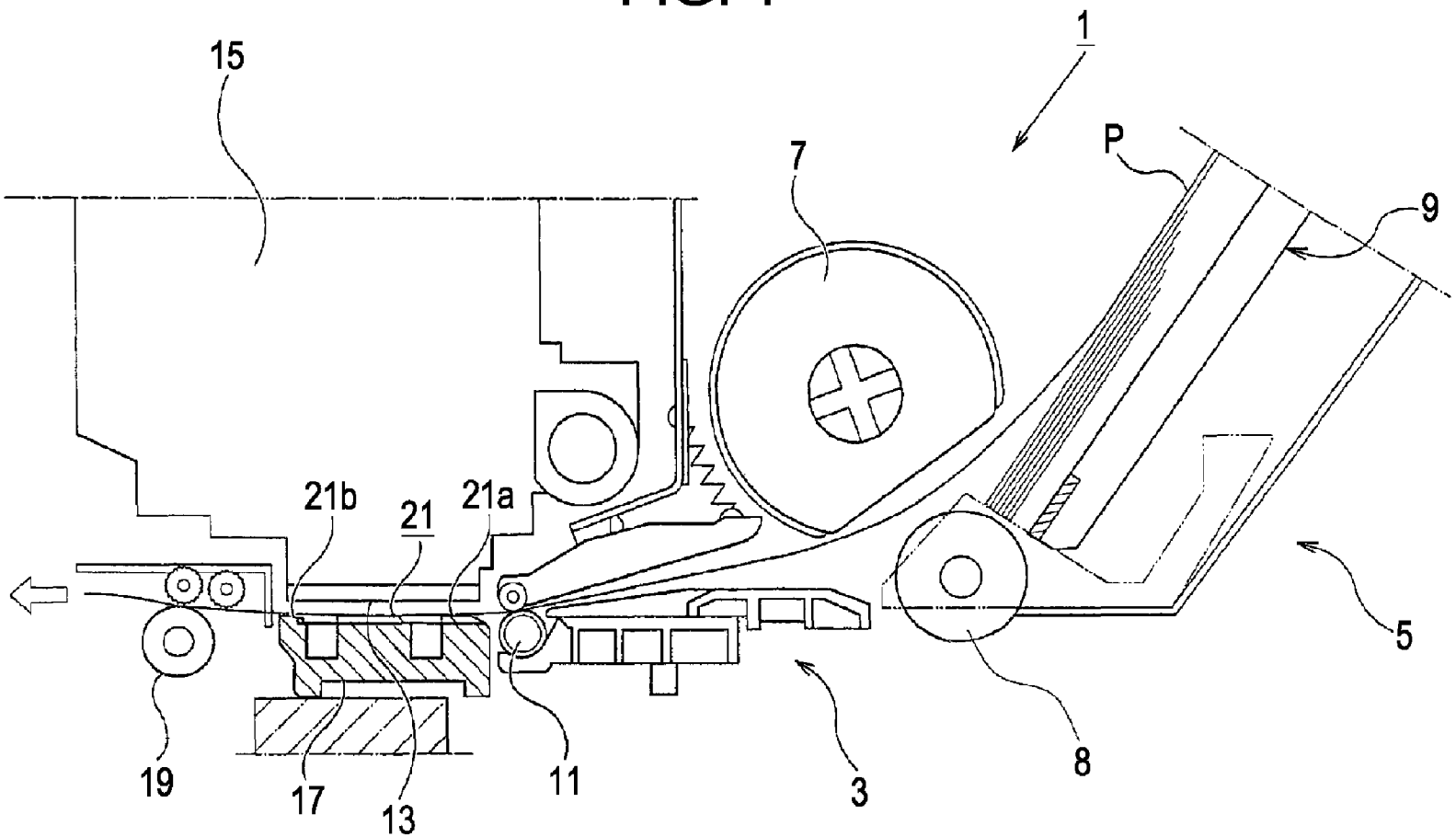
FIG. 1 is a side sectional view of an ink jet recording apparatus to which is applied an ink guiding device according to the invention.
Figure 2:
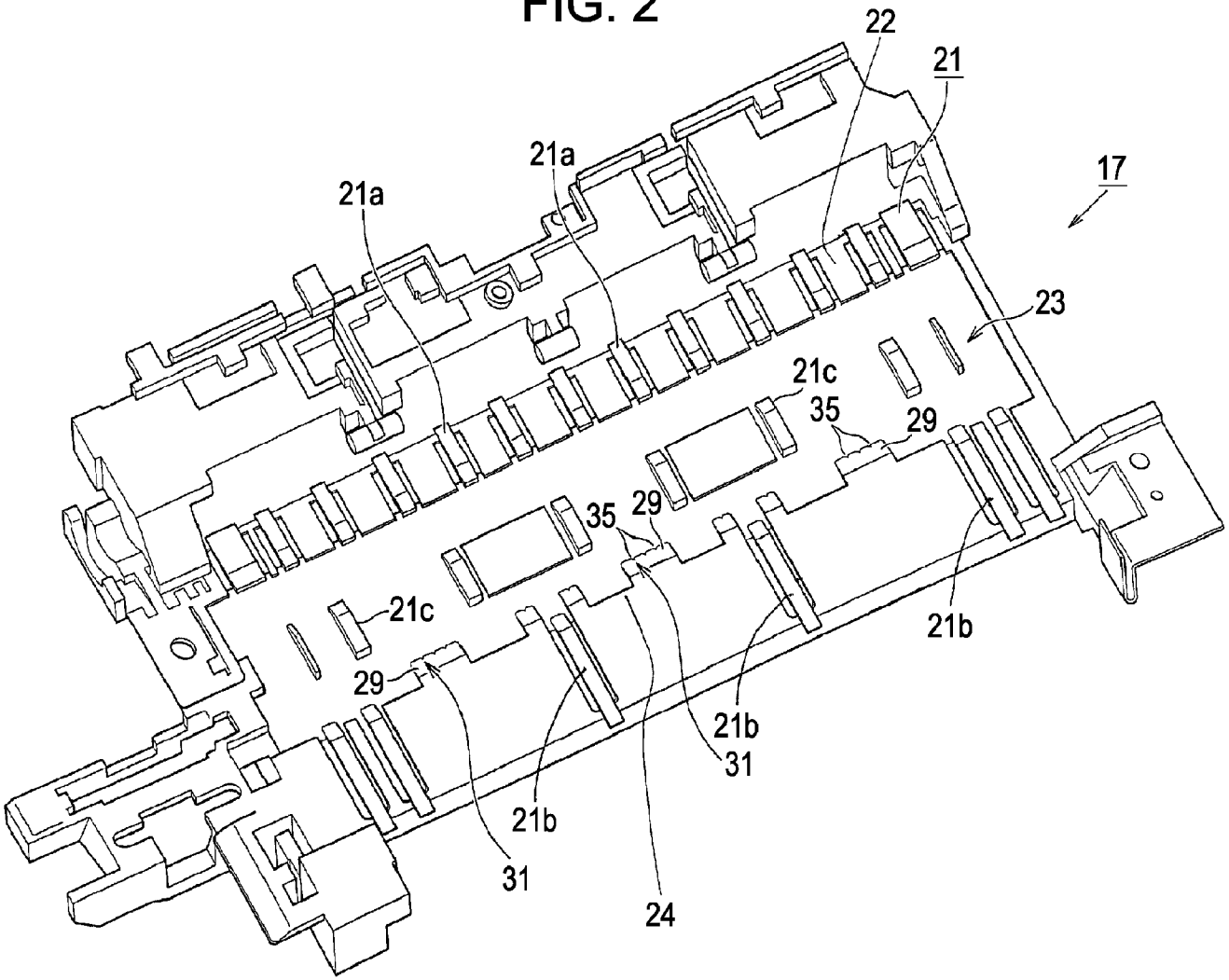
FIG. 2 is an upper perspective view of the vicinity of a platen.
Figure 3:
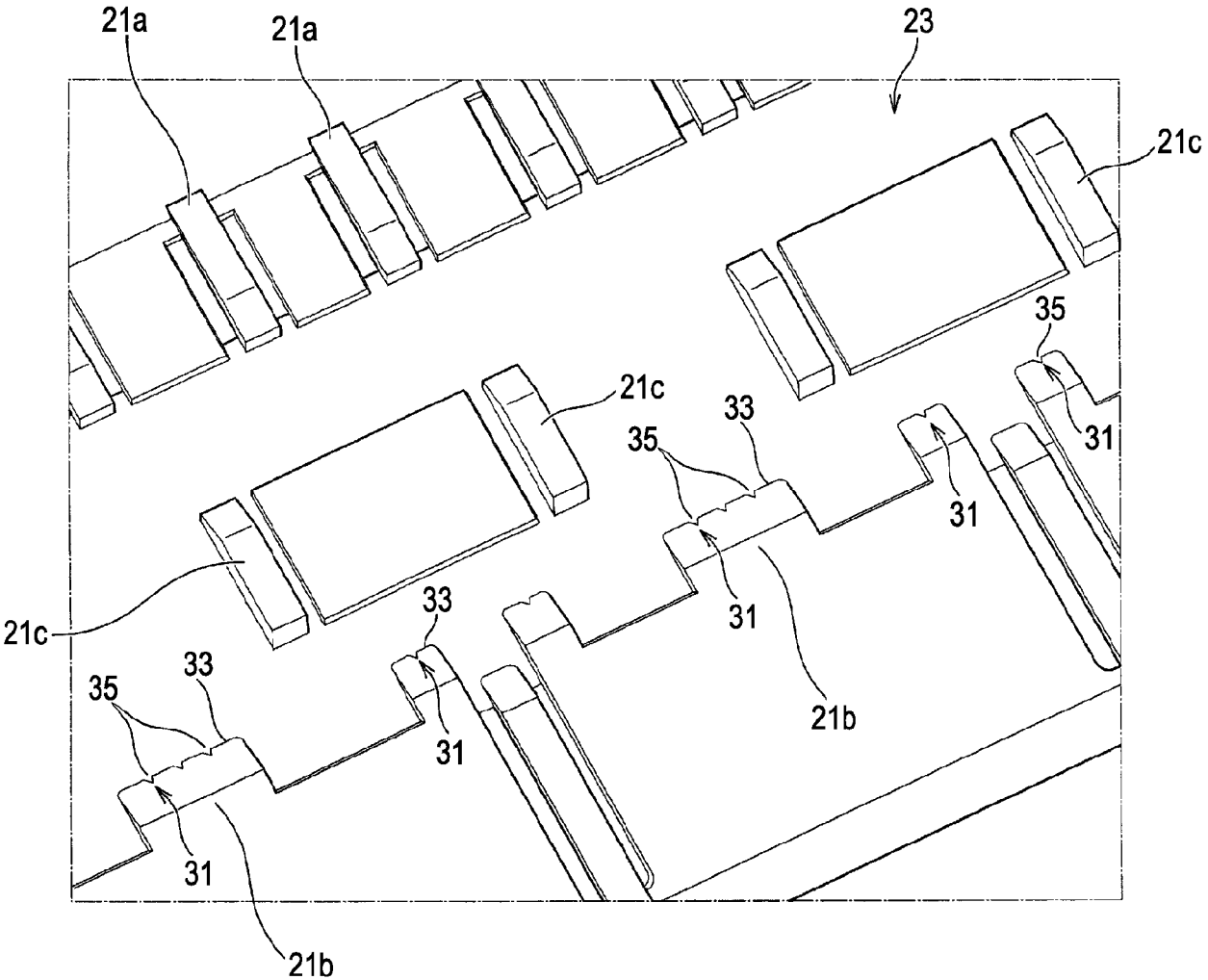
FIG. 3 is an enlarged perspective view of the vicinity of the platen.
Figure 4:
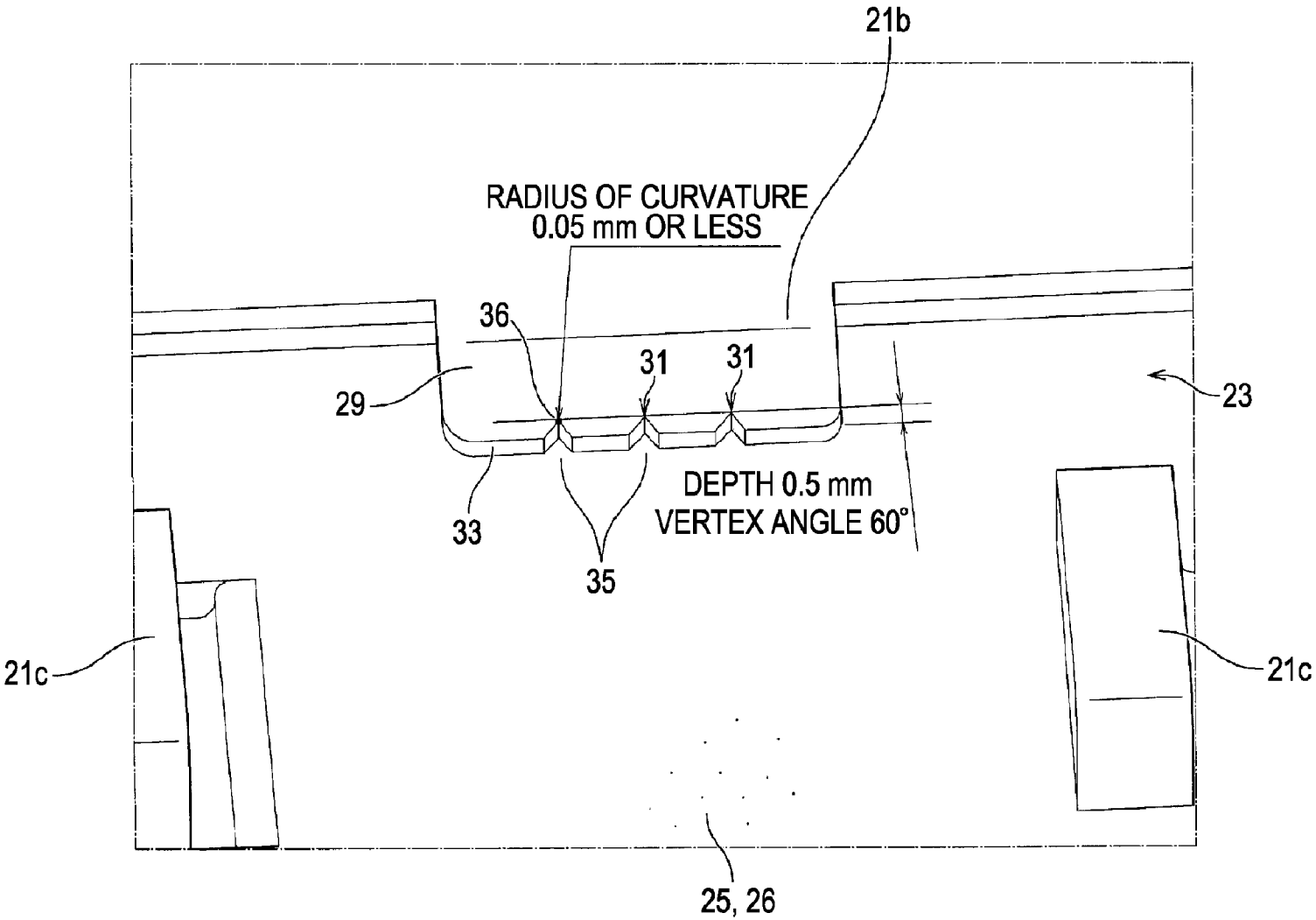
FIG. 4 is a perspective view showing an exemplary embodiment of an ink guiding device.
Figure 5:
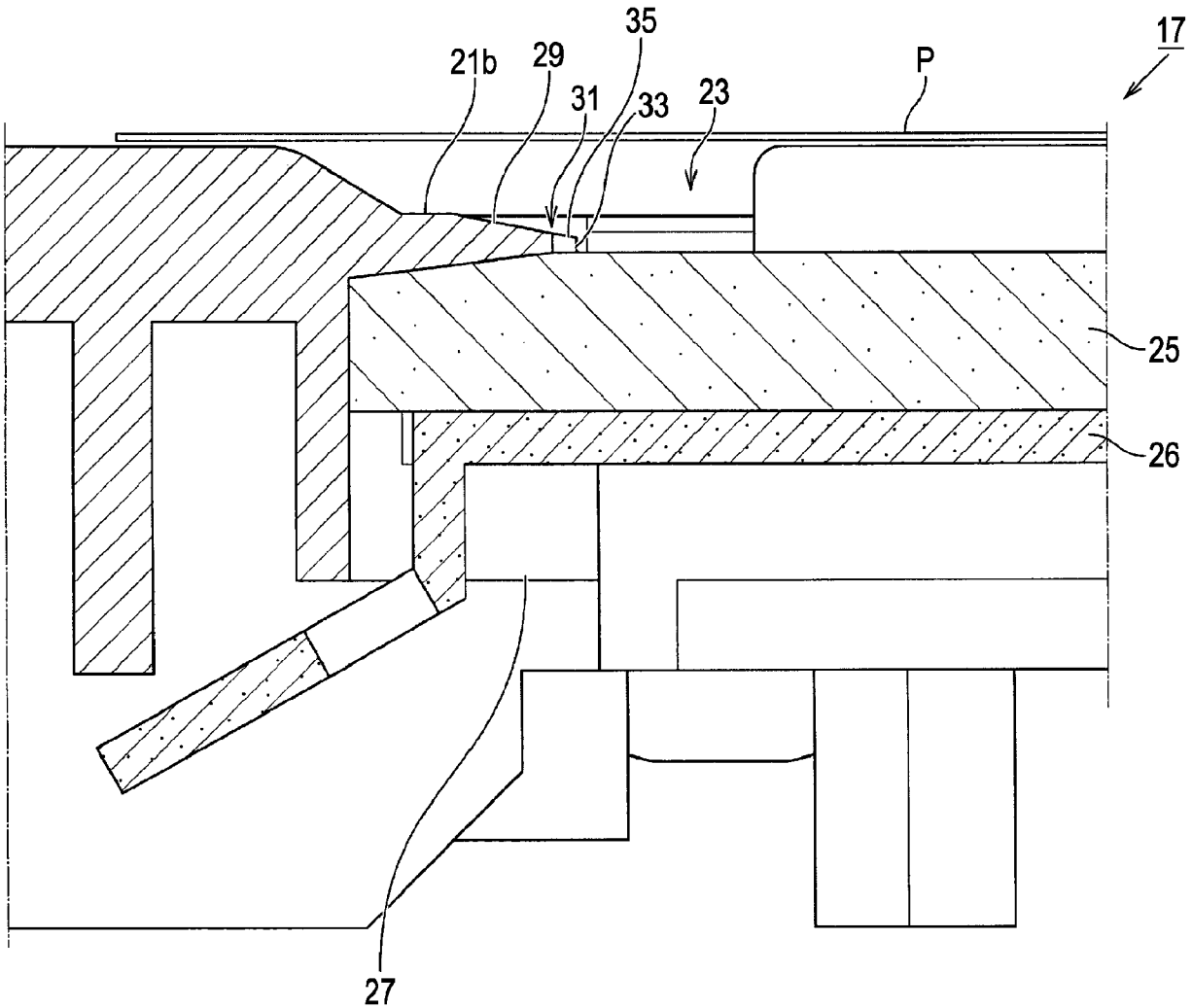
FIG. 5 is a side sectional view of the vicinity of the ink guiding device.

Exemplary embodiments of the invention will now be described with reference to the drawings. FIG. 1 is a side sectional view of an ink jet recording apparatus that is an example of a liquid ejecting apparatus to which is applied an ink guiding device that is an example of a liquid guiding device according to the invention. FIG. 2 is an upper perspective view of the vicinity of a platen. FIG. 3 is an enlarged perspective view of the vicinity of the platen. FIG. 4 is a perspective view showing an exemplary embodiment of an ink guiding device. FIG. 5 is a side sectional view of the vicinity of the ink guiding device.

Figure 6:
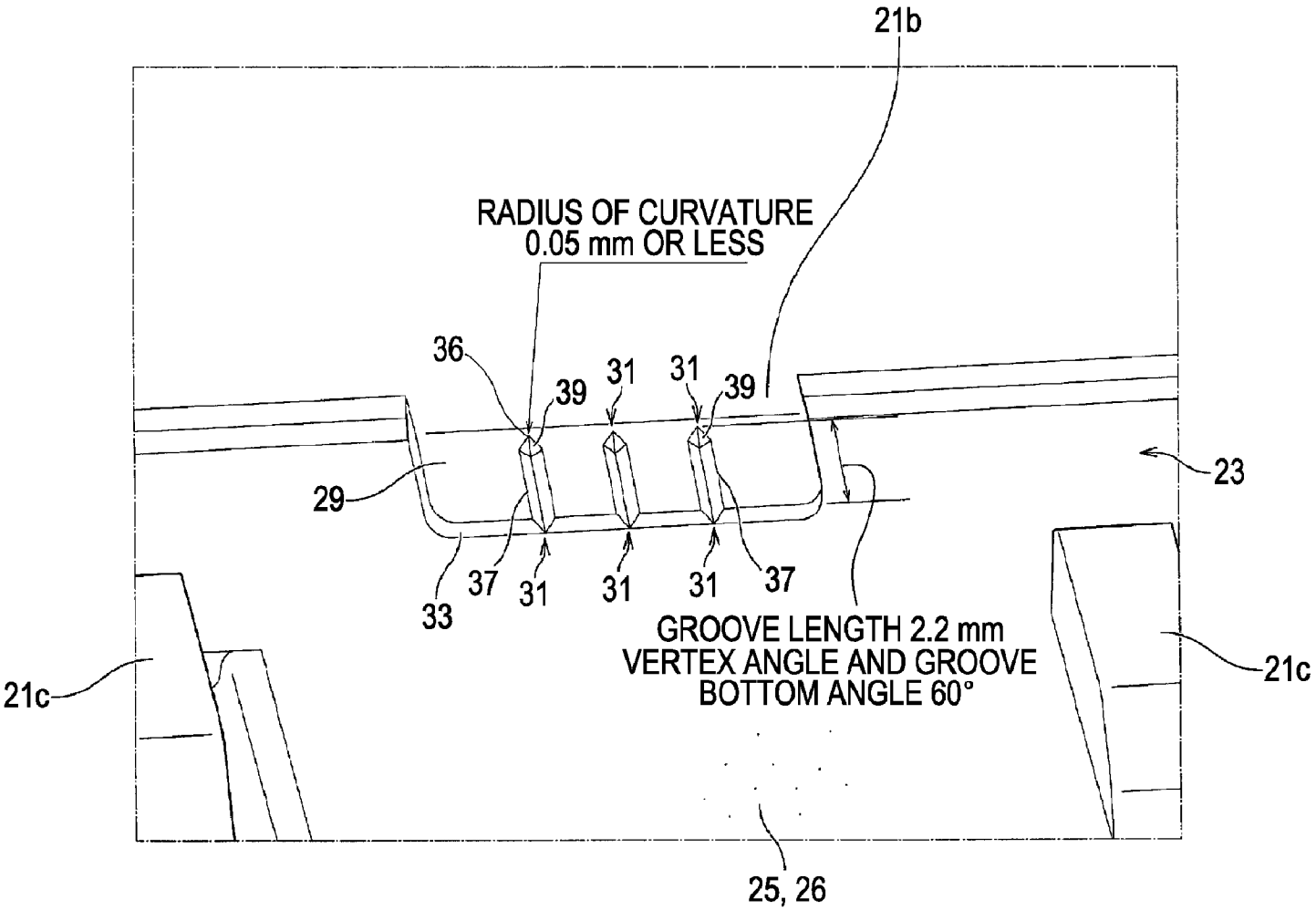
FIG. 6 is a perspective view showing another exemplary embodiment of an ink guiding device.
Figure 7:
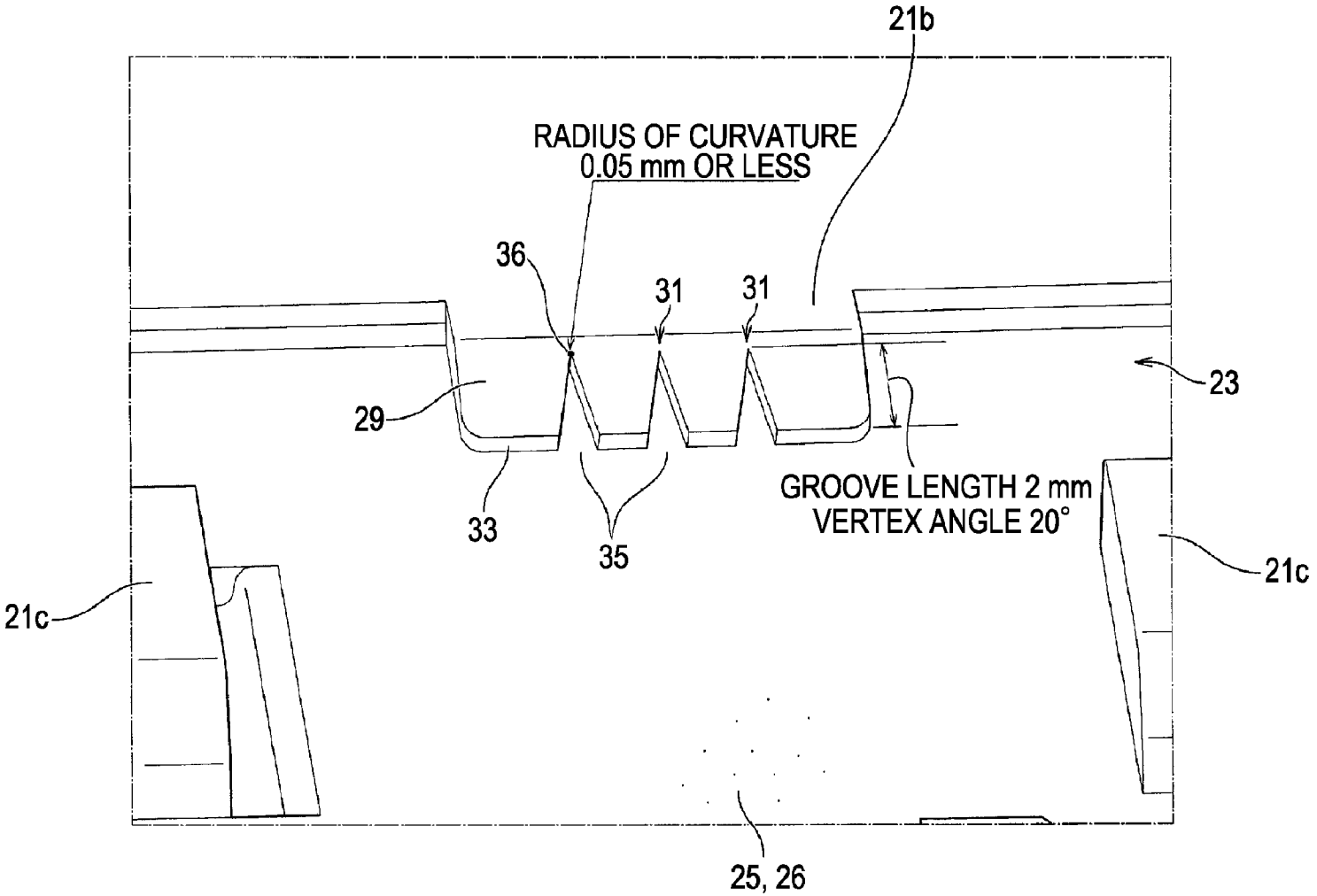
FIG. 7 is a perspective view showing still another exemplary embodiment of an ink guiding device.
Figure 8:
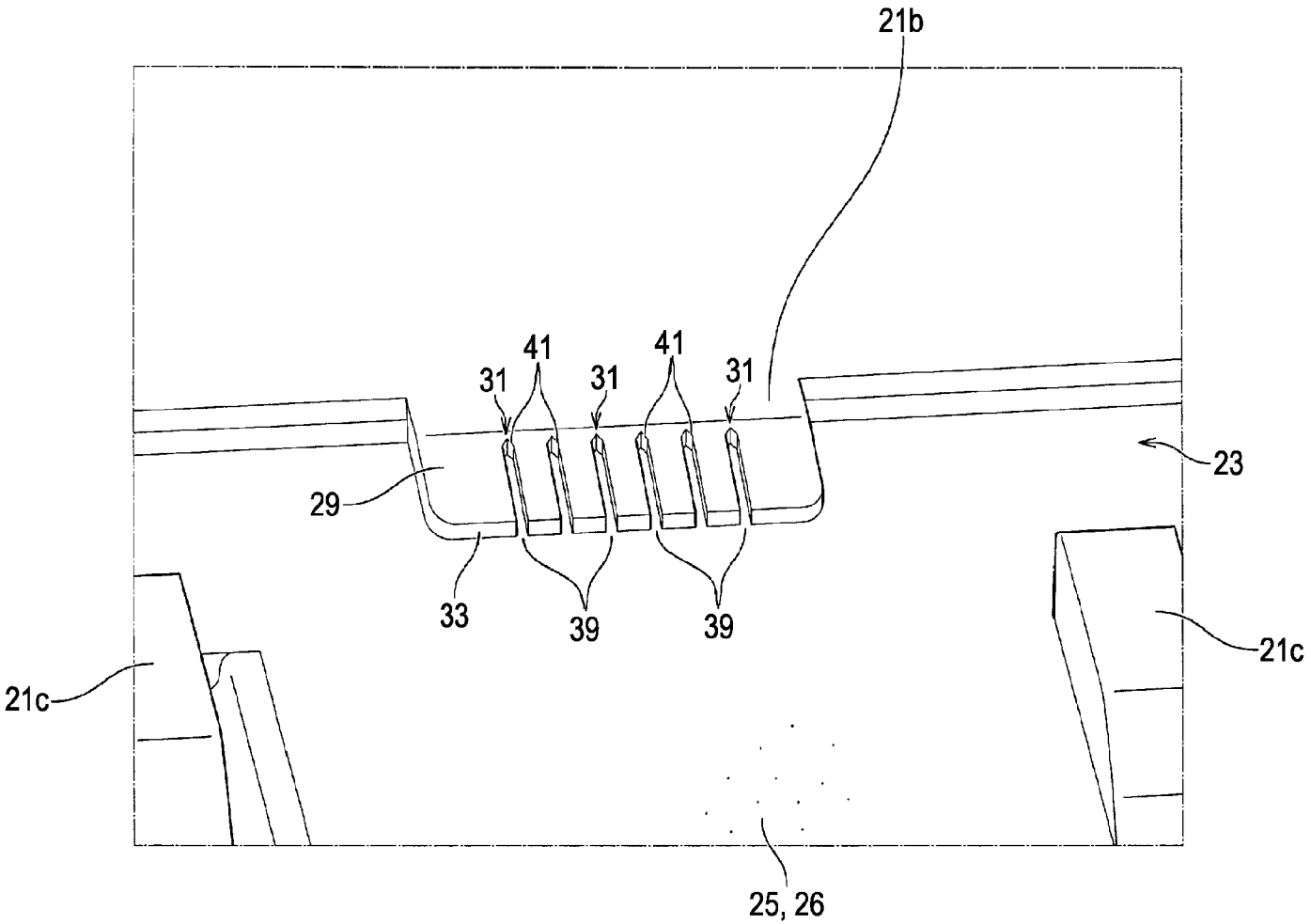
FIG. 8 is a perspective view showing yet another exemplary embodiment of an ink guiding device.
Figure 9:
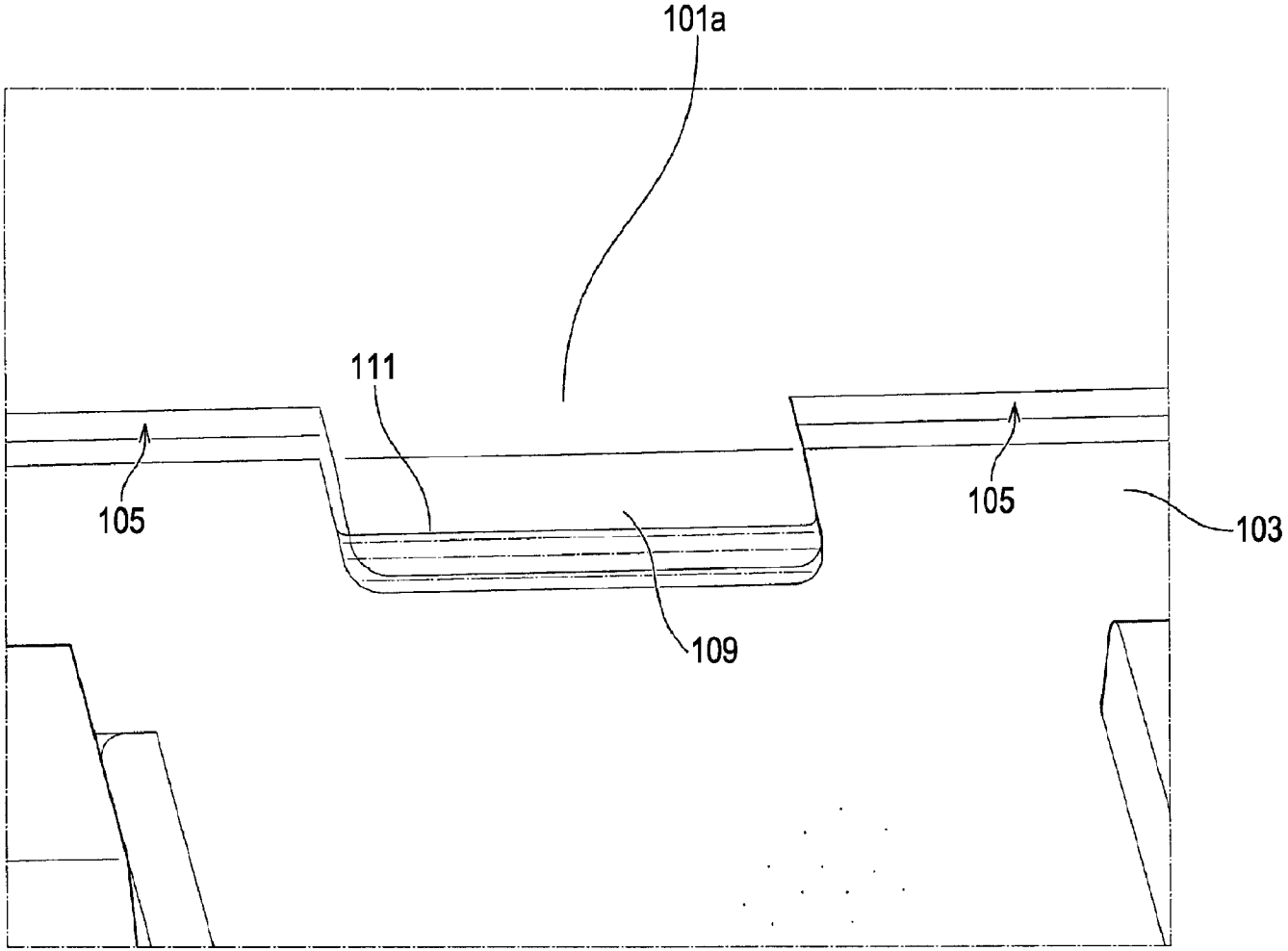
FIG. 9 is a perspective view showing a comparative example of the invention.
Figure 10:
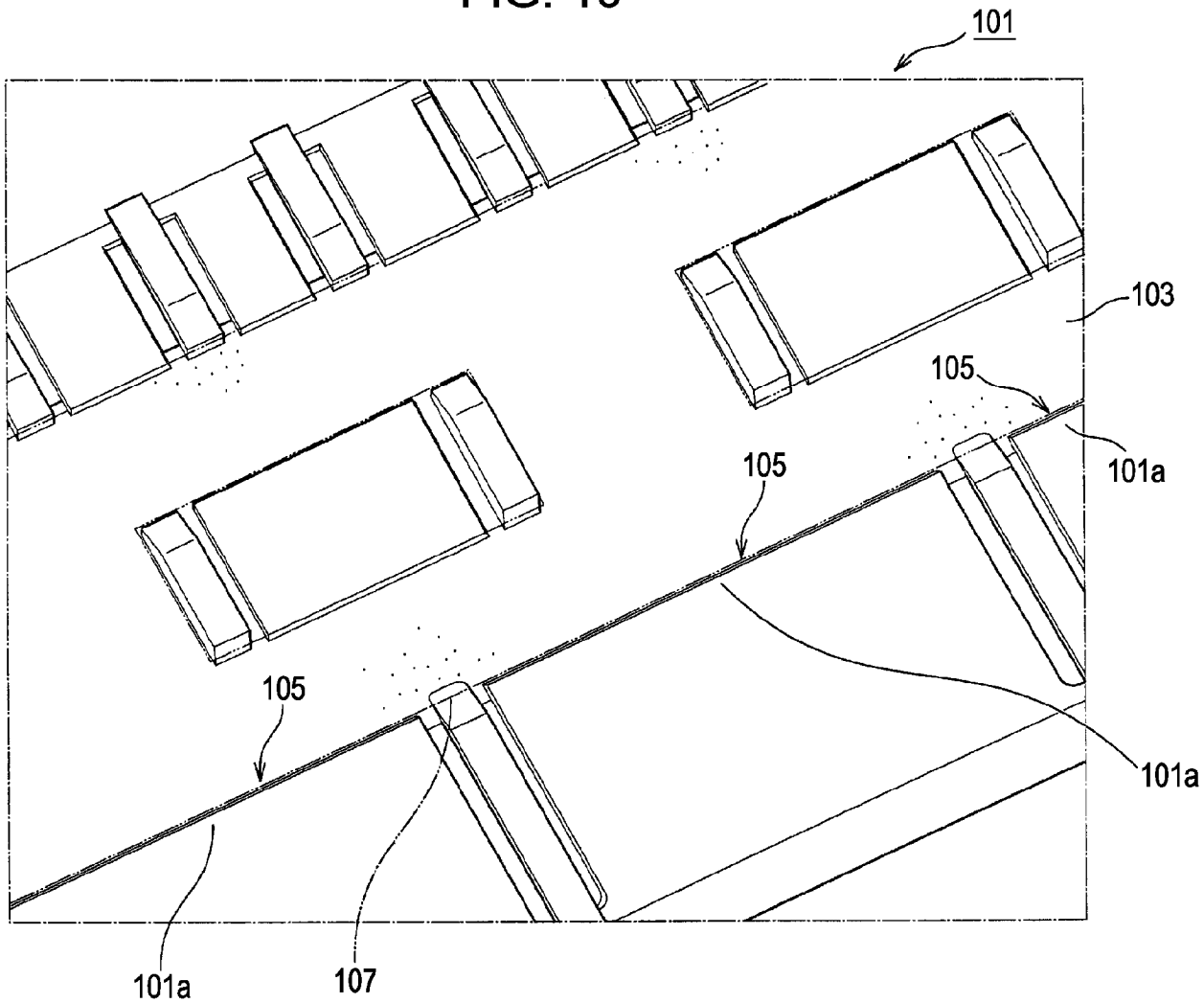
FIG. 10 is a perspective view showing a known art.
Figure 11:
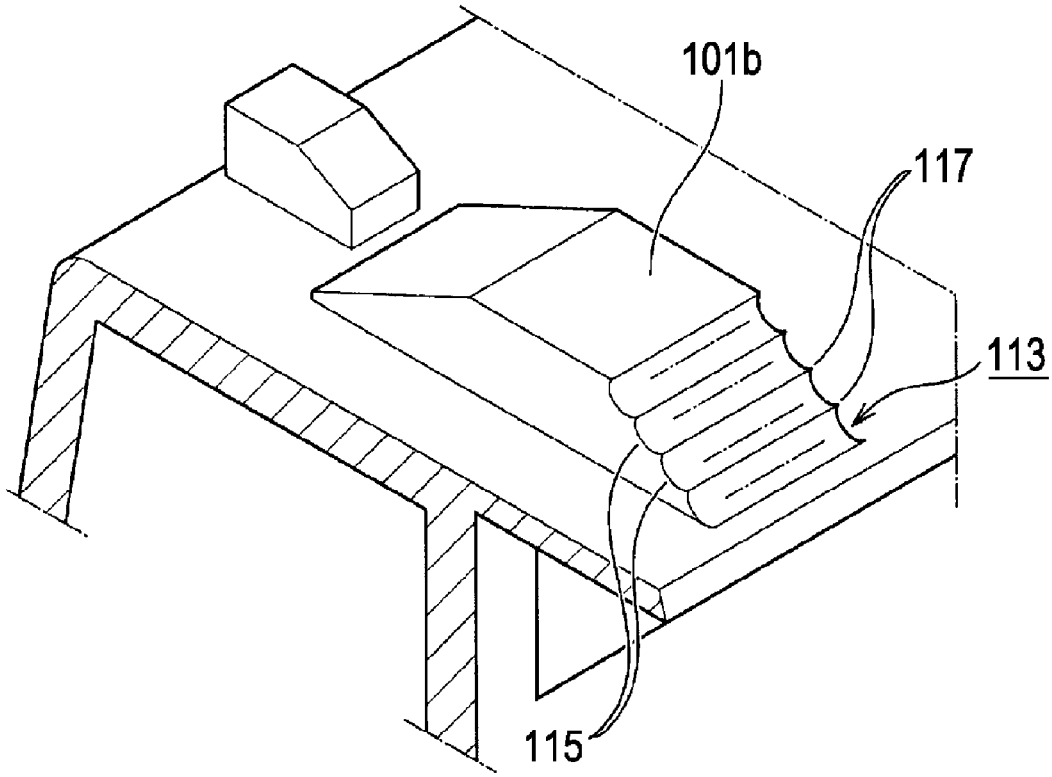
FIG. 11 is a perspective view showing another known art.

FIG. 6 is a perspective view showing another exemplary embodiment of an ink guiding device. FIG. 7 is a perspective view showing still another exemplary embodiment of an ink guiding device. FIG. 8 is a perspective view showing yet another exemplary embodiment of an ink guiding device. FIG. 9 is a perspective view showing a comparative example of the invention.

The ink jet recording apparatus 1 (hereinafter simply referred to as recording apparatus) shown in FIG. 1 has a feeding cassette 5 that is detachable from a main body 3 of the recording apparatus. Recording media P that are stacked in the feeding cassette 5 and that correspond to media to be sprayed are pressed against the outer circumferential surface of a feeding roller 7 by a hopper 9 that rocks toward the feeding roller 7, and are separated and automatically fed to a transporting roller 11 one at a time by driving and rotating of the feeding roller 7. Reference numeral 8 denotes a known retard roller. The retard roller 8 and the feeding roller 7 separate double-fed recording media from one another in cooperation with each other.

A recording head 13 is an example of a liquid ejecting head that performs recording by ejecting ink onto a recording medium P. The main body 3 of the recording apparatus includes a carriage 15 for causing the recording head 13 to scan the recording medium P in the width direction thereof. The carriage 15 is loaded with a detachable ink cartridge (not shown) filled with each color of ink. The ink cartridge supplies the recording head 13 with each color of ink. The recording head 13 reciprocates, facing a platen 17, in the width direction of the recording media P. A line of nozzles are arranged in the surface of the head parallel to the transporting direction of the recording medium P. Ink is discharged from each nozzle hole of the line of nozzles onto the recording medium P being transported on the platen 17, and recording is thereby performed. A range within which the line of nozzles exists in the above transporting direction is an ink (liquid) discharge region. After completion of recording, the recording medium P is output by an output roller 19 in the sub-scanning direction.

As shown in FIG. 2, on the upper surface of the platen 17, which faces the recording head 13, are formed many protrusion-like ribs 21 and a liquid dumping region 23. The ribs 21 support a recording material P and define a distance between the recording medium P and the recording head 13. The liquid dumping region 23 receives ink that is sprayed outside the edges of the recording medium P and that is dumped. The ribs 21 include upstream ribs 21*a* formed in an upstream portion 22 of the platen located upstream in the traveling direction of the recording medium P, downstream ribs 21*b* formed in a downstream portion 24 of the platen located downstream in the traveling direction of the recording medium P, and intermediate ribs 21*c* located in an intermediate region between the upstream ribs 21*a* and the downstream ribs 21*b*. The liquid dumping region 23 is located between the downstream edge of the upstream portion 22 of the platen and the upstream edge of the downstream portion 24 of the platen. Therein are located the intermediate ribs 21*c* like islands.

During recording on the leading edge of the recording medium P, waste ink sprayed on the downstream side of the leading edge of the recording medium P is dumped in a corresponding downstream portion of the liquid dumping region 23. During recording on the trailing edge of the recording medium P, waste ink sprayed on the upstream side of the trailing edge of the recording medium P is dumped in a corresponding upstream portion of the liquid dumping region 23.

As shown in FIG. 5, in the liquid dumping region 23 is provided an ink absorber 25 (corresponding to a liquid absorber) that absorbs and holds dumped ink and that is formed of a polyether based material. Under the ink absorber 25 is provided an absorber 26 (corresponding to a liquid absorber) that is formed of a polyvinyl alcohol based material. A guiding portion 27 is provided on the bottom surface of the liquid dumping region 23. One end of the absorber 26 is guided by the guiding portion 27 so as to be communicated with an ink absorber having a larger capacity. Since the ink absorber 25 and the ink absorber 26 are layers formed of different materials, dumped ink can be guided to the guiding portion 27 more efficiently than in the case of a single material.

As shown in FIG. 4, the upstream edge of the downstream portion 24 of the platen, which defines the downstream end of the liquid dumping region 23, has guiding surface portions 29 that extend into the liquid dumping region 23 with their upper surfaces sloping down toward the upstream side. Each guiding surface portion 29 has edge portions 31 formed therein. The edge portions 31 serve as guiding structure portions that guide ink attached to the guiding surface portion 29 to the ink absorbers 25 and 26. The edge portions 31 guide ink to the ink absorbers 25 and 26 by capillary action.

Each edge portion 31 is located at the vertex of a V-shaped opening 35 that opens toward the upstream end 33 of the guiding surface portion 29. The radius of curvature of the corner 37 of each edge portion 31 is 0.05 mm or less. Due to such a small radius of curvature, when part of ink on the guiding surface portion 29 reaches any one of the edge portions 31 or its vicinity, the ink is quickly guided to the ink absorbers 25 and 26 by capillary action in the edge portion 31.

The vertex angle of the V-shaped openings 35 is 60° in the exemplary embodiment shown in FIG. 4 but is preferably within a range of 20° to 60°. As shown in FIG. 7, the V-shaped openings 35 may extend over substantially the entire length of the guiding surface portion 29 in the direction between the upstream and downstream sides. In the exemplary embodiment shown in FIG. 7, the vertex angle of the V-shaped openings 35 is 20°, and the depth of the openings 35 is 2 mm.

FIG. 6 shows still another exemplary embodiment of the invention. In this exemplary embodiment, each sloping guiding surface portion 29 has elongated grooves 37 formed from the downstream side (the upper side of FIG. 6) to the end on the upstream side (the lower side of FIG. 6) thereof. The elongated grooves 37 have a V-shaped cross section. An edge portion 31 is formed at the lower end of the V-shaped cross section along each elongated groove 37. A terminal end portion 39 cut out in a triangular shape is formed on the downstream side of each elongated groove 37. The terminal end portion 39 also has a V-shaped cross section, at the lower end of which an edge portion 31 is also formed. In each edge portion 31 in this exemplary embodiment, the vertex angle of the lower end of the shape of a V is 60°. The radius of curvature of the corner 37 of each edge portion 31 is 0.05 mm or less. The length of the elongated grooves 37 is 2.2 mm.

In this exemplary embodiment, when part of ink on the guiding surface portion 29 reaches any one of the elongated grooves 37, the ink flows into the edge portion 31. Once such a channel for ink flow is formed, the ink is continuously guided from the upstream end of the elongated groove 37 to the ink absorbers 25 and 26 by capillary action in the edge portions 31.

In the exemplary embodiment shown in FIG. 8, each guiding surface portion 29 has ink guiding structure portions in which slit-like gap portions 39 that penetrate to the underside are formed from the downstream side (the upper side of FIG. 8) to the end on the upstream side (the lower side of FIG. 8). A terminal end portion 41 cut out in a triangular shape is formed on the downstream side (the upper side of FIG. 8) of each slit-like gap portion 39. The terminal end portion 41 has a V-shaped cross section, at the lower end of which an edge portion 31 is formed. In this exemplary embodiment, when part of ink on the guiding surface portion 29 reaches any one of the terminal end portions 41, the ink flows into the edge portion 31. Once such a channel for ink flow is formed, the ink is continuously guided through the gap portion 39 to the ink absorbers 25 and 26 by capillary action in the edge portion 31 and the slit-like gap portion 39.

Although edge portions 31 are shown only on the upper surfaces of the guiding surfaces 29 of the downstream ribs 21*b* in FIG. 2, edge portions 31 may be provided on the edges other than those of the downstream ribs 21*b* in order to obtain the above-described advantages. Edge portions may be provided, for example, in the upper surface of the edge of the platen 17 that abuts the liquid dumping region 23 of the platen or in the upper surface of the edge of the upstream rib 21*a* or the intermediate rib 21*c* that abuts the liquid dumping region 23 of the platen, as long as at least part of the upper surface of the edge is a sloping guiding surface. By providing edge portions in the guiding surface, liquid can be prevented from being attached to the underside of a medium to be sprayed. It goes without saying that the same advantages can be obtained by capillary action when separate protrusions are provided in each guiding surface as a modification of edge portions of each guiding surface.

The invention claimed is:

1. A liquid guiding device in a liquid ejecting apparatus, comprising:

a platen located so as to face a liquid ejecting head;

a liquid dumping region provided in a portion of the platen that faces the liquid ejecting head and that extends beyond a liquid discharge region of the liquid ejecting head, the liquid dumping region having a liquid absorber;

a guiding surface portion provided on an edge of the platen defining a downstream end of the liquid dumping region, the upper surface of the guiding surface portion sloping down toward an upstream end, the guiding surface portion being protruded into the liquid dumping region; and a guiding structure portion provided in the guiding surface portion and guiding liquid attached to the guiding surface portion to the liquid absorber, wherein the guiding structure portion includes an edge portion guiding liquid by capillary action, and the edge portion extends to the liquid absorber, wherein the edge portion is located at the vertex of a V-shaped opening that opens toward the upstream end of the sloping surface of the guiding surface portion.

2. The liquid guiding device in a liquid ejecting apparatus according to claim 1, wherein the V-shaped opening extends over substantially the entire length of the sloping surface in the direction between the upstream and downstream sides.

3. The liquid guiding device in a liquid ejecting apparatus according to claim 1, wherein the radius of curvature of the corner of the edge portion is 0.05 mm or less.

4. A liquid guiding device in a liquid ejecting apparatus, comprising:

a platen located so as to face a liquid ejecting head;

a liquid dumping region provided in a portion of the platen that faces the liquid ejecting head and that extends beyond a liquid discharge region of the liquid ejecting head, the liquid dumping region having a liquid absorber;

a guiding surface portion provided on an edge of the platen defining a downstream end of the liquid dumping region, the upper surface of the guiding surface portion sloping down toward an upstream end, the guiding surface portion being protruded into the liquid dumping region; and a guiding structure portion provided in the guiding surface portion and guiding liquid attached to the guiding surface portion to the liquid absorber, wherein the guiding structure portion includes an edge portion guiding liquid by capillary action, and the edge portion extends to the liquid absorber, wherein the edge portion is located at the lower end of an elongated groove having a V-shaped cross section and extending from the downstream end to the end on the upstream end of the sloping surface of the guiding surface portion.

5. The liquid guiding device in a liquid ejecting apparatus according to claim 4, wherein the edge portion is located at the vertex of a V-shaped opening that opens toward the upstream end of the sloping surface of the guiding surface portion, and wherein the vertex angle of the shape of a V is 20° to 60° .

6. A liquid ejecting apparatus comprising:

a liquid ejecting head;

a platen located so as to face the liquid ejecting head; and a liquid dumping region provided in a portion of the platen that faces the liquid ejecting head and that extends beyond a liquid discharge region of the liquid ejecting head, the liquid dumping region having a liquid absorber, wherein the liquid ejecting apparatus further comprises:

a sloping guiding surface portion provided in at least part of an upper surface of an edge of the platen that abuts the liquid dumping region of the platen or an upper surface of an edge of a rib that abuts the liquid dumping region of the platen; and a guiding structure portion provided in the guiding surface portion and guiding liquid attached to the guiding surface portion to the liquid absorber wherein the guiding structure portion includes an edge portion guiding liquid by capillary action, and the edge portion extends to the liquid absorber, wherein the edge portion is located at the vertex of a V-shaped opening that opens toward an upstream end of the sloping surface of the sloping guiding surface portion.

* * * * *